US006561356B2

(12) United States Patent
Weder

(10) Patent No.: US 6,561,356 B2
(45) **Date of Patent: *May 13, 2003**

(54) PACKAGING MATERIAL

(75) Inventor: Donald E. Weder, Highland, IL (US)

(73) Assignee: Southpac Trust Int'l., Inc.

( * ) Notice: Subject to any disclaimer, the term of this patent is extended or adjusted under 35 U.S.C. 154(b) by 0 days.

This patent is subject to a terminal disclaimer.

(21) Appl. No.: 10/119,170

(22) Filed: Apr. 8, 2002

(65) Prior Publication Data

US 2002/0108884 A1 Aug. 15, 2002

Related U.S. Application Data

(63) Continuation of application No. 09/716,980, filed on Nov. 20, 2000, now Pat. No. 6,390,300, which is a continuation of application No. 09/416,614, filed on Oct. 8, 1999, now Pat. No. 6,189,699, which is a continuation of application No. 09/087,737, filed on May 29, 1998, now Pat. No. 5,992,637, which is a continuation-in-part of application No. 08/892,675, filed on Jul. 14, 1997, now Pat. No. 5,906,280.

(51) Int. Cl.[7] ..... B65D 81/02

(52) U.S. Cl. ..... 206/584

(58) Field of Search ..... 206/86, 99, 521, 206/584, 423; 428/402

(56) References Cited

U.S. PATENT DOCUMENTS

| | | | | |
|---|---|---|---|---|
| 1,865,694 A | | 7/1932 | Johansson | |
| 2,271,180 A | | 1/1942 | Brugger | |
| 2,537,026 A | | 1/1951 | Brugger | |
| 3,047,136 A | | 7/1962 | Graham | 206/584 |
| 3,074,543 A | | 1/1963 | Stanley | 206/584 |
| 3,314,122 A | | 4/1967 | Bundy | 28/1 |
| 3,485,428 A | | 12/1969 | Jackson | 226/97 |
| 4,153,488 A | | 5/1979 | Wiegand | 156/62.2 |
| 4,199,627 A | | 4/1980 | Weder et al. | 428/7 |
| 4,292,266 A | | 9/1981 | Weder et al. | 264/140 |
| 4,401,700 A | | 8/1983 | Weder et al. | 428/17 |
| 4,549,908 A | | 10/1985 | Weder et al. | 106/266 |
| 4,568,581 A | | 2/1986 | Peoples, Jr. | 428/35 |
| 5,134,013 A | | 7/1992 | Parker | 428/182 |
| 5,312,665 A | | 5/1994 | Pratt et al. | 428/402 |
| 5,397,413 A | | 3/1995 | Trimble et al. | 156/167 |
| 5,468,556 A | | 11/1995 | Fuss et al. | 428/369 |
| 5,472,779 A | | 12/1995 | Cann et al. | 428/402 |
| 5,603,406 A | | 2/1997 | Weder | 206/423 |
| 5,674,344 A | | 10/1997 | Thompson et al. | 206/584 |
| 5,699,645 A | | 12/1997 | Vaccarello | 206/584 |
| 5,873,465 A | | 2/1999 | Weder | 206/584 |
| 5,897,926 A | | 4/1999 | Mikulas | 428/17 |
| 5,906,280 A | * | 5/1999 | Weder | 206/584 |
| 5,992,637 A | * | 11/1999 | Weder | 206/584 |
| 6,053,323 A | | 4/2000 | Weder | 206/584 |
| 6,053,324 A | | 4/2000 | Weder | 428/153 |
| 6,067,779 A | | 5/2000 | Weder | 53/472 |
| 6,189,699 B1 | * | 2/2001 | Weder | 206/584 |
| 6,390,300 B1 | * | 5/2002 | Weder | 206/584 |

* cited by examiner

*Primary Examiner*—David T. Fidei
(74) *Attorney, Agent, or Firm*—Dunlap Codding & Rogers

(57) ABSTRACT

A packaging material comprising a plurality of flexible strips of material integrally interconnected to one another along one end thereof so as to form a unitary mass and so that the strips of material are intertwineable with one another to form a resilient tuft. The strips of material interconnected via a border have a bonding material disposed thereon for bondingly connecting the packaging material to a container.

19 Claims, 7 Drawing Sheets

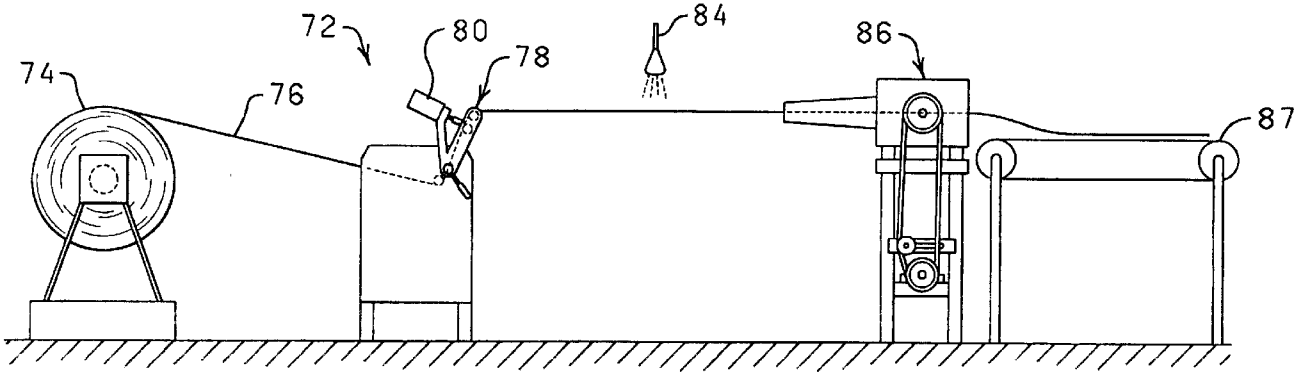
FIG. 9
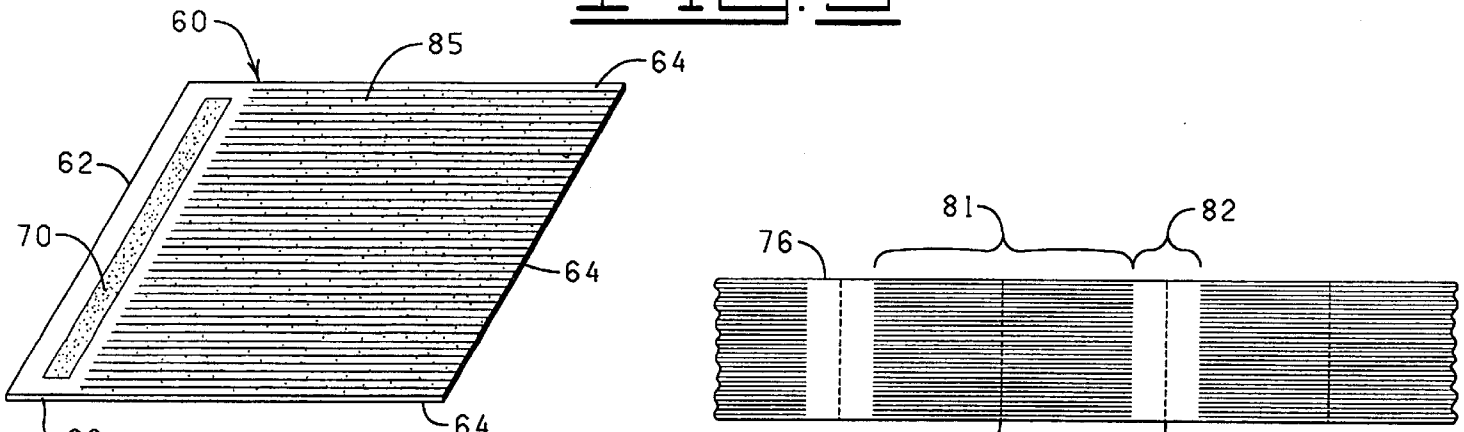
FIG. 8
FIG. 10

PACKAGING MATERIAL

CROSS-REFERENCE TO RELATED APPLICATIONS

This application is a continuation of U.S. Ser. No. 09/716,980, filed Nov. 20, 2000, now U.S. Pat. No. 6,390,300, which is a continuation of U.S. Ser. No. 09/416,614, filed Oct. 8, 1999, now U.S. Pat. No. 6,189,699, which is a continuation of U.S. Ser. No. 09/087,737, filed May 29, 1998, now U.S. Pat. No. 5,992,637, which is a continuation-in-part of U.S. Ser. No. 08/892,675, filed Jul. 14, 1997, now U.S. Pat. No. 5,906,280.

STATEMENT REGARDING FEDERALLY SPONSORED RESEARCH-OR DEVELOPMENT

Not applicable.

BACKGROUND OF THE INVENTION

1. Field of the Invention

The present invention relates generally to packaging materials for packaging articles, and more particularly, but not by way of limitation, to a packaging material which includes a plurality of resilient strip members integrally interconnected to one another to form a unitary cushioning unit.

2. Brief Description of the Related Art

In the process of shipping an article from one location to another, the article is typically placed in a container along with a protective packaging material to fill the voids about the article and to cushion the article during the shipping process. One common protective packaging material is comprised of a plurality of plastic foam, peanut-shaped members which are commonly known as "styrofoam peanuts." An advantage in using styrofoam peanuts is the ease with which they may be disposed about an article positioned in a container by simply pouring the styrofoam peanuts from a dispenser.

However, while styrofoam peanuts have been widely accepted in the packaging industry, they are not without disadvantages. For example, the light weight and flowability of the styrofoam peanuts results in heavier objects gravitating through the peanuts to the bottom of the container where the object can be damaged. Also, while the flowability of the styrofoam peanuts facilitates the introduction of the peanuts into a container, the receiver of the package is left with having to deal with the peanuts upon removal of the article from the container in the form of having to clean up the mess left by the peanuts which are easily scattered upon removal of the article from the container.

These and other disadvantages associated with the disposal of styrofoam peanuts has made paper protective packaging material a popular alternative. Paper is biodegradable, recyclable and renewable, making it an environmentally responsible choice. However, like styrofoam peanuts, paper packaging materials is not without disadvantages in that paper, particularly shredded paper, can be inconvenient to clean up and to dispose of due to the lack of cohesiveness of the packaging material. In addition, due to the lack of resiliency in paper products, large amounts of paper are typically required to provide the bulk needed to adequately cushion an object.

Strips of sheet material formed into tufts have also been used for many years. More specifically, material known as decorative grass has been used in fruit baskets, Easter baskets, and picnic baskets and for other decorative purposes. In addition, decorative grass has been use as a packaging material. The decorative grass of the prior art has been produced by numerous methods and from a variety of materials such as polymeric materials, paper, cellophane or the like. Typically, such materials are cut and shredded to produce segments having predetermined dimensions. As such, decorative grass, like styrofoam peanuts and paper materials described above, can be inconvenient to clean up and to dispose of.

To this end, a packaging material is needed that includes a plurality of resilient strip members interconnected to one another so as to form a unitary cushioning unit. It is to such a packaging material that the present invention is directed.

BRIEF SUMMARY OF THE INVENTION

The present invention is directed to a packaging material for use in filling baskets and protecting articles during a shipping process. The packaging material includes a plurality of strips of flexible material integrally interconnected to one another along one end thereof so as to form a unitary mass and so that the strips of material are intertwineable with one another to form a resilient tuft.

The present invention is also directed to a packaging material comprising a flexible sheet of material having a border with a first end having a plurality of the narrow strips of material extending therefrom and a second end having a plurality of narrow strips of material extending therefrom such that the strips of material are integrally interconnected to one another so as to form a unitary mass and such that the strips of material are intertwineable with one another to form a resilient tuft.

The tuft formed from the plurality of strips of material may be incorporated into a package which additionally includes a container and an article positioned within the container. The tuft is arranged about the article to substantially surround the article positioned within the container. The tuft may also be caused to bond to the article and the container. In this manner, the tuft will function as a protective packaging material which fills any voids and/or which cushions the article during a shipping process.

The objects, features and advantages of the present invention will become apparent from the following detailed description when read in conjunction with the accompanying drawings and appended claims.

BRIEF DESCRIPTION OF THE SEVERAL VIEWS OF THE DRAWING

FIG. 8 is a perspective view of a sheet of packaging material constructed in accordance with the present invention.

FIG. 9 is a schematic representation of a system for making the packaging material of FIG. 8.

FIG. 10 is a plan view of a portion of a web of slitted material.

DETAILED DESCRIPTION OF THE INVENTION

Figure 1:
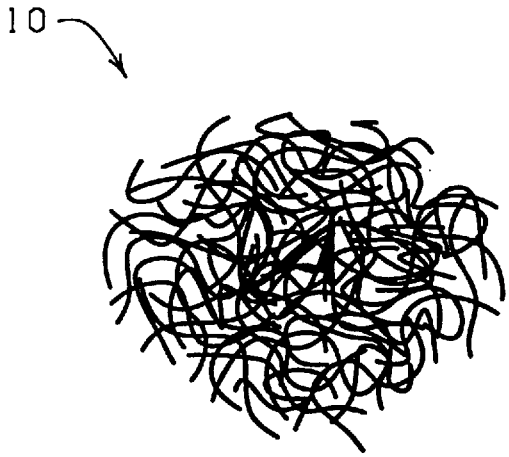
FIG. 1 is a perspective view of a tuft of packaging material constructed in accordance with the present invention.
Figure 2:
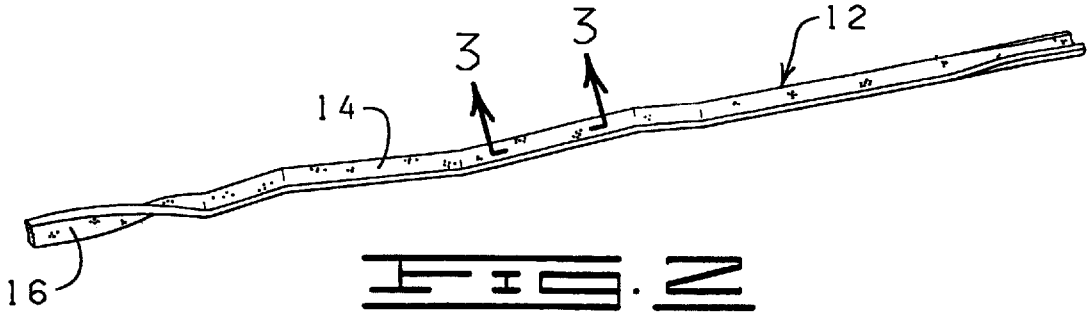
FIG. 2 is a perspective view of a strip of material used to form the tuft of packaging material of FIG. 1.
Figure 3:
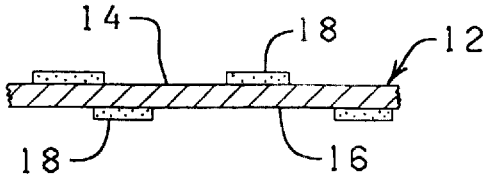
FIG. 3 is an enlarged, fractional, cross-sectional view of the strip of material shown in FIG. 2 taken along line 3—3 of FIG. 2.

Referring now to the drawings, and more specifically to FIGS. 1–3, a tuft 10 of packaging material constructed in accordance with the present invention is illustrated in FIG. 1. The tuft 10 is comprised of a plurality of individual strips or strands of material 12 (FIG. 2), each characterized as having a first side 14 and a second side 16. The strips of material 12 can be fabricated from any flexible sheet of material, including paper, crepe paper, polymeric film, laminated polymeric film, and waxed paper, for example. The sheet of material may have printed matter and/or embossed pattern on at least one side thereof, and the embossed pattern can be either in register or out of register with the printed pattern.

The printed pattern can be printed on the sheet of material in a conventional matter so that when the sheet of material is slit and cut to produce the strips of material 12, at least a substantial portion of the strip of material 12 contains at least a portion of the printed pattern. Further, different colors can be employed to provide the printed pattern on the sheet of material.

The sheet of material can also be embossed so as to provide the sheet of material with an embossed pattern. Further, the sheet of material can be provided with an embossed pattern as well as a printed pattern, and the embossed pattern can be either in register or out of register with the printed material and/or printed design.

The strips of material 12 as briefly described above are referred to as "Easter grass" or "decorative grass", and as mentioned above, decorative grass has been used for many years for filling fruit baskets, Easter baskets, and picnic baskets and for other decorative and packaging purposes. The decorative grass of the prior art has been produced by numerous methods and from a variety of materials, such as those listed above. Typically, such log materials are shredded and cut to produce segmented strips having-predetermined dimensions. While the prior art methods for making decorative grass have been widely accepted, new methods for making decorative grasses with different aesthetic and functional qualities have been sought.

One technique for achieving these desired effects is to coat the strips of material 12 with a bonding material such as an adhesive or cohesive whereby the individual strips of material 12 are caused to stick together when a plurality of the strips of material 12 are amassed to form a tuft, such as the tuft 10 shown in FIG. 1. As best shown in FIG. 3, the strip of material 12 is provided with a bonding material 18. The strip of material 12 is illustrated in FIG. 3 as being spot coated with the bonding material 18 on the first side 14 and the second side 16 wherein the bonding material 18 is disposed as randomly disposed spots on the first and second sides 14 and 16 of the strip of material 12. It will be appreciated, however, that the bonding material 18 may be applied in such a manner as to substantially cover one or both of the first and second sides 14 and 16 of the strip of material 12, or as strips. Further, the bonding material 18 may be disposed in any of a variety of other patterns such as circles, dots or any other geometric or biomorphic shape, including decorative designs, so long as the bonding material 18 is positioned to function in accordance with the present invention.

The term "bonding material" when used herein can mean an adhesive, frequently a pressure sensitive adhesive, or a cohesive or any adhesive/cohesive combination, having adhesive qualities (i.e., qualities of adhesion or adhesion/cohesion, respectively) sufficient to effect the connection between adjacent strips of material 12 brought into engagement with one another, between the strips of material 12 and an object such as a basket, box or other container and objects disposed in such containers. It will be appreciated that both adhesives and cohesives are well known in the art, and both are commercially available.

Figure 4:
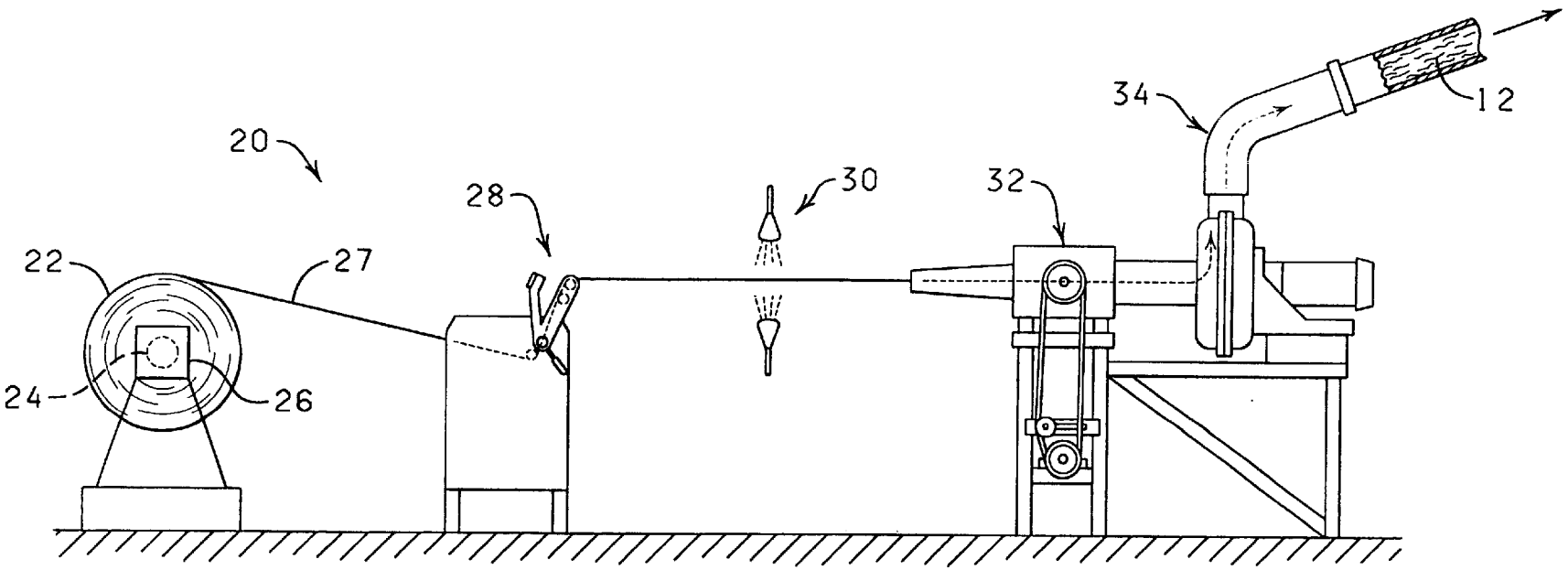
FIG. 4 is a schematic representation of a system for making the strip of material of FIG. 2.

FIG. 4 schematically illustrates a system 20 for making strips of material 12 in accordance with the present invention. The system 20 includes a roll of material 22 supported on a shaft 24 having a brake assembly 26 operably connected thereto for controlling the rate of withdrawal of the material from the roll of material 22.

The roll of material 22 provides a web of sheet material 27 which is passed through a slitter 28. The slitter 28 includes a plurality of spaced apart, stationary knives or other conventional cutting mechanism, which slit or cut the web of sheet material 27 into strips or strands of desired width.

An effective amount of the bonding material 18 is next applied to the slitted web of sheet material 27 to provide the desired coverage by a spray assembly 30, or by some other suitable means for applying the bonding material such as, for example, by brushing or rolling the bonding material onto the slitted web of sheet material 27.

After the bonding material 18 has been applied to the slitted web of sheet material 27, the slitted web of sheet material 27 is passed into a cutter 32 where the slitted web of sheet material 27 is cut into predetermined lengths so as to form the strips of material 12. From the cutter 32, the strips of material 12 are conveyed by a conveyor unit 34, which is in the form of a centrifugal blower, to a storage area (not shown) which may be in the form of a suitable bin, packaging machine, or the like.

As an alternative to forming the decorative grass from the roll of material 22, it will be appreciated that the strips of material 12 may be formed from a polymeric film discharged from a film extrusion die which is then chilled prior to the slitting process. Such a method is disclosed in U.S. Pat. No. 4,292,266, entitled "Process for Making Decorative Grass", issued to Weder et al. on Sep. 29, 1981, which is hereby expressly incorporated herein by reference. Also, while the bonding material 18 is shown herein as being applied to the web of sheet material 27 after the slitting step, it will be appreciated that the bonding material 18 may be applied to the web of sheet material 27 prior to the slitting step or to the formed strips of material 12 after such are cut to length.

As illustrated in FIG. 2, the strips of material 12 tend to curl and form folds during the forming process. It will be appreciated that these curls and folds contribute to the resiliency and bulkiness or fluffiness of the tuft 10 produced by amassing and intertwining a plurality of the strips of material 12. It will be further appreciated that the degree to which the strips of material 12 are curled and folded can vary dependant on several factors, such as the type of material used to form the strips of material 12, as well as the type of bonding material applied to the strips of material 12 and the amount of bonding material applied.

Figure 5:
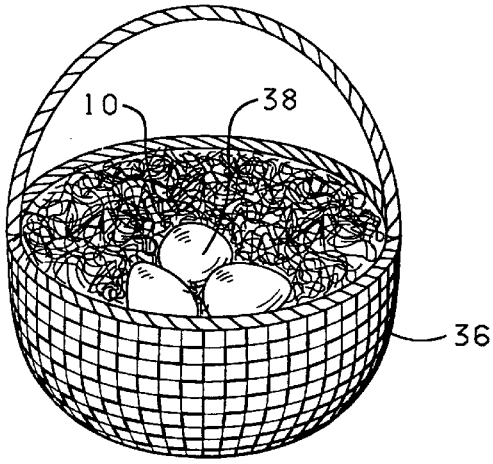
FIG. 5 is a perspective view of a basket having a tuft of packaging material disposed therein with a plurality of objects displayed on the tuft.
Figure 6:
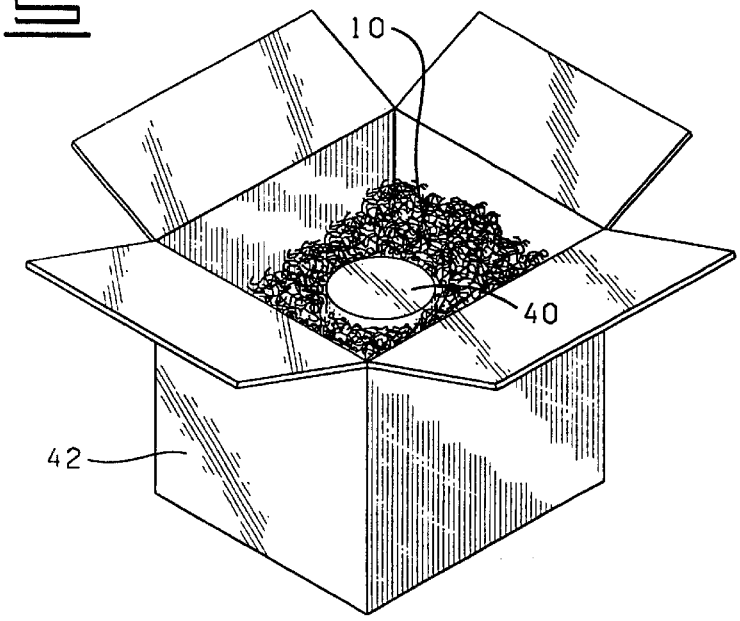
FIG. 6 is a perspective view of a package illustrating the tuft of packaging material used as a packaging material for cushioning an article during a shipping process.

In use, the strips of material 12 are amassed, intertwined, and bondably connected to form the tuft 10. FIG. 5 illustrates one use of the strips of material 12 described above. That is, the tuft 10 fabricated from the strips of material 12 is shown disposed in a basket 36 and supporting a plurality of objects 38, such as candies or Easter eggs, for display. FIG. 6 illustrates an alternative use for the strips of material 12. In FIG. 6, the tuft 10 fabricated from the strips of material 12 is being used as a packaging material for protecting an article 40 disposed in a container 42. In this manner, the tuft 10 functions as a protective packaging material which fills any voids and cushions the article during transport.

An advantage of applying the bonding material 18 to the strips of material 12 is that the degree of springiness or fluffiness of the tuft 10 can be controlled. That is, a problem experienced with the use of some decorative grasses in the filling of gift baskets and Easter baskets is that the fluffiness or springiness of the decorative grass causes objects, such as candy and fruit, displayed on the decorative grass, to be expelled from the basket or moved to a different position in the basket. As such, it is desirable to be able to control the amount of resiliency or springiness of the at decorative grass. By bonding the strips of material 12 to one another, the degree to which the strips of material 12 are able to flex relative to one another can be controlled through the amount of bonding material 18 applied to the strips of material 12 and the tack of the bonding material 18.

Another advantage of having the strips of material 12 bond to one another includes the mess associated with loose packing or filler materials falling onto the floor or clinging to various objects being alleviated. Also, the tuft 10 fabricated of the strips of material 12 can be caused to adhere or cohere to an object and/or container resulting in an enhanced packing effect. That is, with loose packing materials, the object being packed has a tendency to gravitate through the packing material to the bottom of the container thereby reducing the effectiveness of the packing material. By using the strips of material 12 disclosed herein, the cohesiveness of the tuft 10 surrounding the object prevents the object from gravitating through the decorative grass.

In addition, the use of a bonding material 18 on the strips of material 12 enhances the shape sustaining characteristics of the tuft 10. When the strips of material 12 are amassed to form the tuft 10, each strip of material 12 is normally bent and folded when a crushing force is applied to the tuft 10 whereby the strips of material 12 are caused to be flattened thereby giving the tuft 10 a lesser cushioning quality. With the strips of material 12 adhered to one another, the strips of material 12 are caused to maintain their folds in opposition to forces attempting to flatten the folds, thereby giving the tuft 10 greater crush resistance and providing enhanced capabilities as a functional packaging material in that the strips of material 12 which are more difficult to crush would continue to occupy space and create a cushioning effect. As such, a lesser quantity of the strips of material 12 provided with the bonding material 18 could have the same cushioning effect and occupy the same volume as that of a larger quantity of non-treated strips of material.

In addition to the functional advantages provided by the strips of material 12, the ability of the strips of material 12 to adhere to one another also permits the creation of various decorative effects. For example, because the strips of material 12 are able to adhere to one another, one may cause the strips of material 12 to clump in a variety of different configurations. In other words, the strips of material 12 treated with the bonding material 18 can be manipulated into a desired form or shape as to result in a desired decorative effect.

It will be appreciated that the qualities and characteristics of the tuft 10 formed from a plurality of the strips of material 12 can be varied depending on the number of surfaces of the strip of material 12 the bonding material 18 is applied to, the pattern in which the bonding material 18 is applied, and the tackiness of the bonding material 18 used.

Figure 7:
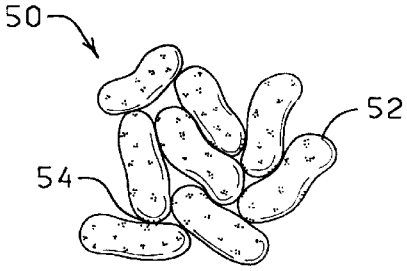
FIG. 7 is a perspective view of a mass of styrofoam peanuts constructed in accordance with the present invention.

In addition to the above mentioned advantages of the strips of material 12 treated with the bonding material 18, FIG. 7 illustrates the concept of treating other conventional packaging Ho materials with a bonding material to form a cohesive unit. More specifically, FIG. 7 illustrates a packaging material 50 comprising a plurality of plastic foam, peanut shaped members 52, which are commonly known as "styrofoam peanuts", coated with a bonding material 54. The bonding material 54 can be any suitable adhesive or cohesive which can be used to effect the bonding or connecting of two adjacent styrofoam peanuts 52. Also the "tack" of the bonding material 54 may be varied depending on the bonding characteristics desired. The bonding material 54 may be disposed on the outer surface of the styrofoam peanuts 52 by any conventional manner which may include spraying, rolling, or brushing. Also, the bonding material 54 may be applied to the styrofoam peanuts 52 as a solid coat, strips, spots, or any combination thereof.

By treating the styrofoam peanuts 52 with the bonding material 54, the problems associated with objects gravitating through the peanuts to the bottom of a container is reduced or eliminated and the mess associated with the use of styrofoam peanuts 52 is reduced. That is, by the styrofoam peanuts 52 being maintained as a cohesive unit, they are less likely to become scattered across a room or blown by the wind thereby facilitating reuse or disposal of, the styrofoam peanuts 52.

Referring now to FIG. 8, a packaging material 60 constructed in accordance with the present invention is illustrated. The packaging material 60 includes a sheet of flexible material 62 having a plurality of individual strips or strands of material 64 extending from a border 66 whereby the strips of flexible material 64 are integrally interconnected to one another along one end thereof. As such, the strips of material may be intertwined with one another so as to form a resilient tuft, as described below, while the mess associated with loose packing or filler materials It falling onto the floor or clinging to various objects is alleviated.

The packaging material 60 can be fabricated from any flexible sheet of material, including paper, crepe paper, polymeric film, laminated polymeric film, and waxed paper, for example. Further, any thickness or stiffness of the sheet of material 62 may be utilized in accordance with the present invention so long as the strips of material 64 are sufficiently flexible and resilient to function as a cushioning material, as described herein. The sheet of material 62 preferably has a thickness of from about 0.1 mil to about 30 mils. The sheet of material may have printed matter and/or embossed pattern on at least one side thereof, and the embossed pattern can be either in register or out of register with the printed pattern.

The printed pattern can be printed on the sheet of material 62 in a conventional manner so that when the sheet of material is slit and cut to produce the strips of material 64, at least a substantial portion of the strip of material 64 contains at least a portion of the printed pattern. Further, different colors can be employed to provide the printed pattern on the sheet of material 62.

The sheet of material 62 can also be embossed so as to provide the sheet of material 62 with an embossed pattern. Further, the sheet of material 62 can be provided with an embossed pattern as well as a printed pattern, and the embossed pattern can be either in register or out of register with the printed material and/or printed design.

The sheet of material 62 can be of any shape, configuration or size so long as the sheet of material 62 is sufficiently sized and shaped to be formed into the packaging material 60. For example, the sheet of material 62 may have a square, rectangular, round, oval, octagonal or asymmetrical shape.

To secure the packaging material 60 within a container, such as a basket 68 (FIG. 11), for example, at least one side of the border 66 may be provided with a bonding material 70. The border 66 is illustrated in FIG. 8 as having a strip of bonding material 70. It will be appreciated, however, that the bonding material 70 may be applied in such a manner as to substantially cover one or both of the first and second sides of the border 66. Further, the bonding material 70 may be disposed in any of a variety of other patterns such as circles, dots or any other geometric or biomorphic shape, including decorative designs, so long as the bonding material 70 is positioned to function in accordance with the present invention.

The term "bonding material" when used herein can mean an adhesive, frequently a pressure sensitive adhesive, or a cohesive or any adhesive/cohesive combination, having adhesive qualities (i.e., qualities of adhesion or adhesion/cohesion, respectively) sufficient to effect the connection between the border and an object such as a basket, box or other container. It will be appreciated that both adhesives and cohesives are well known in the art, and both are commercially available.

FIG. 9 schematically illustrates a system 72 for making the packaging material 60 in accordance with the present invention. The system 72 includes a roll of material 74 which provides a web of sheet material 76. The web of sheet of material 76 is passed through a slitter 78. The slitter 78 includes a plurality of spaced apart knives or other conventional cutting mechanism, which are capable of slitting or cutting the web of sheet material 76 into strips or strands of desired width. The slitter 78 is mounted to an actuator 80 adapted to move the slitter 78 between a web engaging position wherein the slitter 78 cuttingly engages the web of sheet material 76 to form a slit portion 81 (FIG. 10) along the web of sheet material 76 and a non-engaging position wherein the slitter 78 is disengaged from the web of sheet material to allow for the formation of a border portion 82 (FIG. 10) as the web of sheet material 76 passes by the disengaged slitter 78. The slit portions. 81 and the border portions 82 will generally be twice the length of the border and the strips of an individual unit of the packaging material 60 whereby individual units of the packaging material 60 can be formed by bisecting the border portions 82 and the slit portions 81, as designated in FIG. 10 at numerals 83*a* and 83*b*, respectively.

An effective amount of the bonding material 70 is next applied to the border portions 82 created on the slitted web of sheet material 76 to provide the desired coverage by a spray assembly 84, or by some other suitable means for applying the bonding material 70 such as, for example, by brushing or rolling the bonding material 70 onto the border areas of the slitted web of sheet material 76.

As an alternative, or in addition, to providing the border 66 with the bonding material 70, the strips of material 64 can be coated with a bonding material in the manner described above in reference to the strips of material 12, whereby the individual strips of material 64 of the packaging material 60 are caused to stick together when the strips of material 64 are amassed to form a tuft, as described below. As shown in FIG. 8, the strips of material 64 are provided with a bonding material 85. The strips of material 64 are illustrated in FIG. 8 as being spot coated with the bonding material 85 on one side with the bonding material 85 disposed as randomly disposed spots on the strips of material 64. It will be appreciated, however, that the bonding material 85 may be applied in such a manner as to substantially cover one or both sides of the strips of material 64, or as strips. Further, the bonding material 85 may be disposed in any of a variety of other patterns such as circles, dots or any other geometric or biomorphic shape, including decorative designs, so long as the bonding material 85 is positioned to function in accordance with the present invention.

After the bonding material 70 and/or 85 has been applied to im, the web of sheet material 76, the slitted web of sheet material 76 is passed into a cutter 86 where the slitted web of sheet material 76 is cut into predetermined lengths so as to form the packaging material 60 by cutting the web of sheet material 76 across the slit portion 81 at 83*b* and across the border portion 82 at 83*a*, as illustrated in FIG. 10, thereby forming individual units of the packaging material 60 illustrated in FIG. 8.

From the cutter 86, the packaging material 60 is conveyed by a conveyor unit 87 to a packaging area (not shown) where the individual units of the packaging material 60 are packaged. Alternatively, a plurality of sheets of the packaging material 60 can be stacked and formed into a pad. Also, the sheets of the packaging material 60 can be formed into a roll of material. In this instance, the slitted web of sheet material 76 would be perforated so as to define individual sheets of the packaging material 60, rather than cut completely, so that the sheets of the packaging material 60 remain connected to one another and yet can be easily separated from an adjacent sheet when desired.

The bonding material 70, if present, may have a backing or release strip (not shown). The backing or release strip may be left applied for a period of time to the bonding material 70 prior to its use as a packaging material, to protect the bonding qualities of the bonding material 70.

As an alternative to forming the packaging material from the roll of material 74, it will be appreciated that the packaging material 60 may be formed from a polymeric film discharged from a film extrusion die which is then chilled prior to the slitting process. Such a method is disclosed in U.S. Pat. No. 4,292,266, entitled "Process for Making Decorative Grass", issued to Weder et al. on Sep. 29, 1981, which is hereby expressly incorporated herein by reference. Also, while the bonding material 70 is shown herein as being applied to the web of sheet material 76 after the slitting step, it will be appreciated that the bonding material 70 may be applied to the web of sheet material 76 prior to the slitting step or to the formed packaging material 60 after such are cut to length.

In use, the border 66 of the packaging material 60 is preferably secured to the interior surface of a container, such as the basket 68, via the bonding material 70. The border 66 can be secured to the interior surface of the basket 68 with the border 66 being oriented in a variety of different directions. However, one manner of securing the border 66 to the interior surface of the basket 68 is to extend the border 66 circumferentially along the sidewall of the basket 68. Depending on the length of the border 66, the border 66 can be extended along the sidewall of the basket in a helical fashion, thereby increasing the density of the strips of material 64. With the border 66 secured to the basket 68, the strips of material 64 can be amassed and intertwined to form a resilient tuft 88. In this manner, the strips of material 64 will support a plurality of objects 90, such as candies or Easter eggs, for display, and remain in the basket.

It will be appreciated that the packaging material 60 can be effectively utilized without having to secure the packaging material 60 to the basket 68. In this instance, the packaging material 60 is simply placed in the basket 68 and the strips of material 64 are amassed and Intertwined to form the resilient tuft 88.

Figure 12:
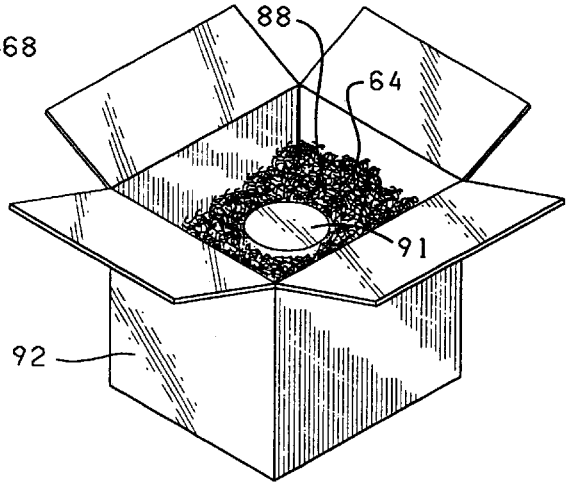
FIG. 12 is a perspective view of a package illustrating the tuft of the packaging material of FIG. 8 used to cushion an article during a shipping process.

FIG. 12 illustrates an alternative use for the packaging material 60. In FIG. 12, the tuft 88 fabricated from the strips of material 64 is being used as a packaging material for protecting an article 91 disposed in a container 92. In this manner, the tuft 88 functions as a protective packaging material which fills any voids and cushions the article during transport.

Figure 13:
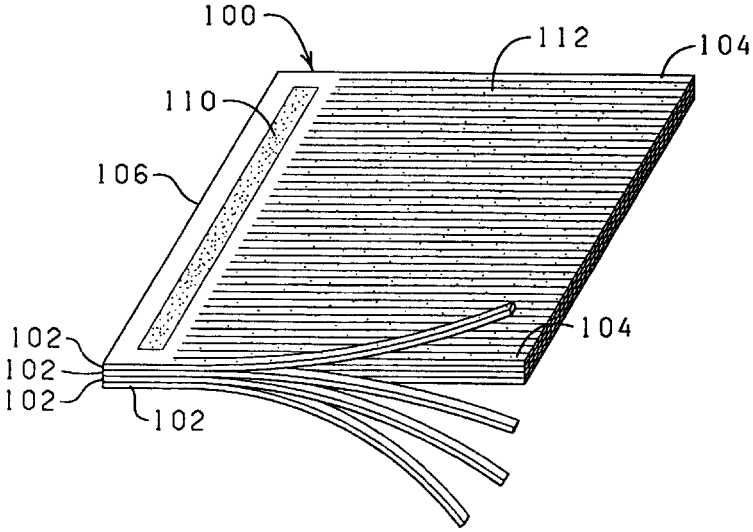
FIG. 13 is perspective view of another embodiment of a packaging material constructed in accordance with the present invention.
Figure 14:
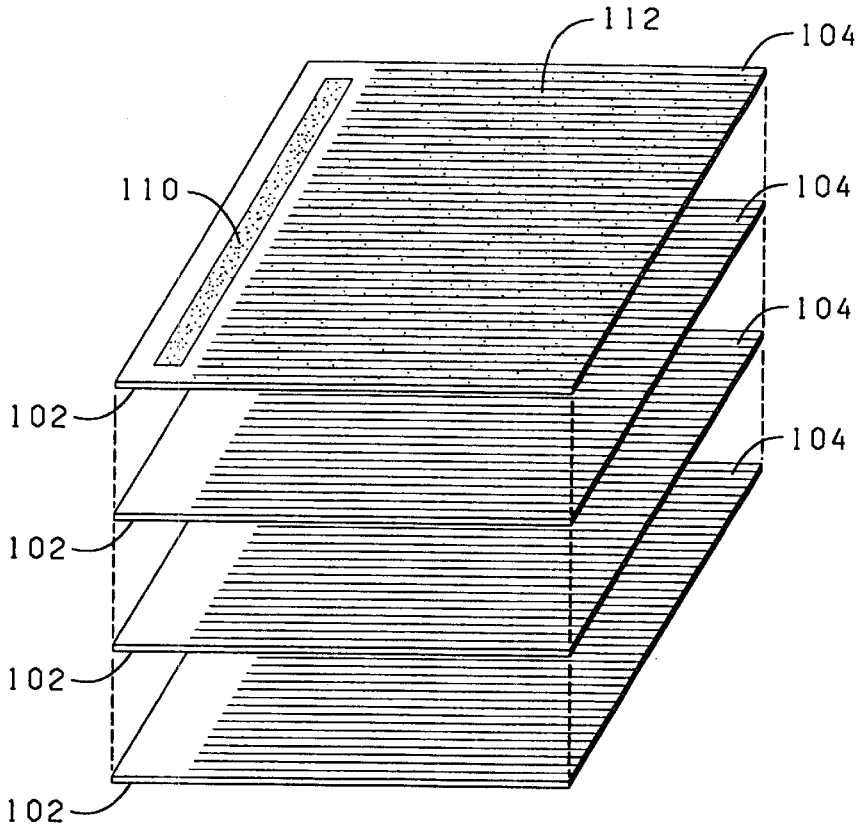
FIG. 14 is an exploded, perspective view of the packaging material of FIG. 13.

Referring now to FIGS. 13 and 14, another embodiment of a packaging material 100 is illustrated. The packaging material 100 is constructed of a plurality of sheets of material 102 stacked and bonded together. Each sheet of material 102 is substantially identical to the sheets of material 62 described above. That is, each sheet of material 102 has a plurality of individual strips or strands of material 104 extending from a border 106 whereby the strips of flexible material 104 are integrally interconnected to one another along one end thereof.

The sheets of material 102 are shown in FIG. 13 stacked and bonded together at the border 106 with the sheets of material 102 being generally aligned with one another. It will be appreciated that any number of sheets of material 102 can be incorporated into the packaging material 100 depending on the density of the strips of material 104 desired. It will also be appreciated that the sheets of material 102 can be stacked and bonded together with the sheets of material 102 arranged in a variety of other configurations relative to one another, such as with the strips of material 104 of every other sheet of material 102 being oriented in a direction opposite the direction of orientation of the adjacent sheets of material 102.

The bonding of the sheets of material 102 can be achieved in any suitable manner. That is, the sheets of material 102 can be connected together with an adhesive or a cohesive. Where the bonding material is a cohesive, a similar cohesive material must be placed on the adjacent surface for bondingly contacting and bondingly engaging with the cohesive material. The sheets of material 102 can also be connected together with materials which are heat sealable and, in this instance, the adjacent portions of the material must be brought into contact and then heat must be applied to effect the seal. The sheets of material 102 can be connected with a heat sealing lacquer which may be applied to the sheet of material and, in this instance, heat also must be applied to effect the sealing. It should be understood that the bonding of the sheets of material 102 can be achieved with tape, staples, or any other connecting means well known in the art.

To secure the packaging material 100 within a container, such as a basket 68 (FIG. 11), for example, at least one side of the border 106 of an outermost sheet of material 102 of the packaging material 100 may be provided with a bonding material. The border 106 is illustrated in FIG. 13 as having a strip of bonding material 110. It will be appreciated, however, that the bonding material 110, like the bonding material 70 described above, may be applied in such a manner as to substantially cover one or both of the first and second sides of the border 106. Further, the bonding material 110 may be disposed in any of a variety of other patterns such as circles, dots or any other geometric or biomorphic shape, including decorative designs, so long as the bonding material 110 is positioned to function in accordance with the present invention.

As an alternative, or in addition, to providing the border 106 with the bonding material 110, the strips of material 104 can be coated with a bonding material in the manner described above in reference to the strips of material 12 and 64, whereby the individual strips of material 104 of the packaging material 100 are caused to stick together when the strips of material 104 are amassed to form a tuft. As shown in FIG. 13, the strips of material 64 are provided with a bonding material 112. The strips of material. 104 are illustrated in FIG. 13 as being spot coated with the bonding material 112. It will be appreciated, however, that the bonding material 112 may be applied in such a manner as to substantially cover one or both sides of the strips of material 104, or as strips. Further, the bonding material 112 may be disposed in any of a variety of other patterns such as circles, dots or any other geometric or biomorphic shape, including decorative designs, so long as the bonding material 112 is positioned to function in accordance with the present invention.

The packaging material 100 is used in a manner identical to that described above in relation to the packaging material 60.

Figure 15:
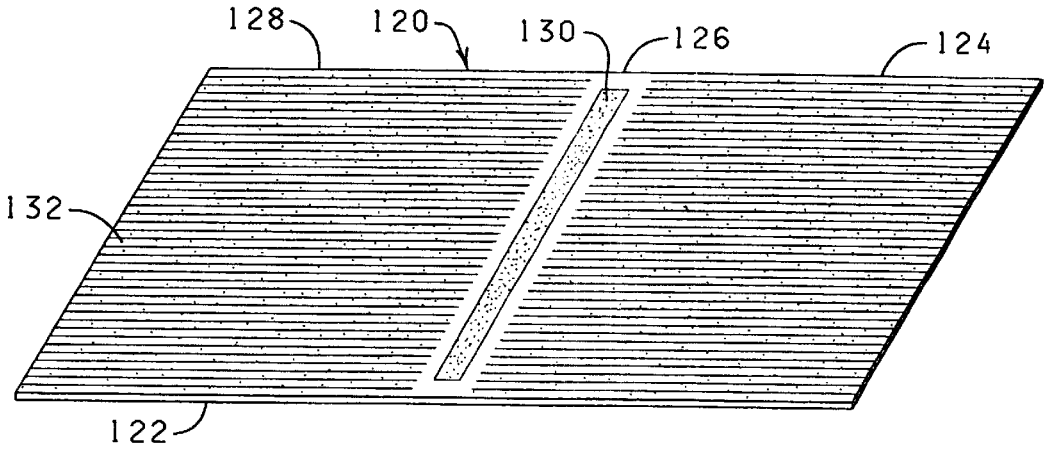
FIG. 15 is perspective view of another embodiment of a packaging material constructed in accordance with the present invention.

FIG. 15 illustrates another embodiment of a packaging material 120. The packaging material 120 is similar to the packaging material 60 described above with the exception that the packaging material 120 has strips of material extending from opposing ends of the border. More specifically, the packaging material 120 includes a sheet of flexible material 122 having a plurality of individual strips or strands of material 124 extending from one end of a border 126 and a plurality of strips of material 128 extending from an opposing end of the border 126 whereby the strips of flexible material 124 and 128 are integrally interconnected to one another. As such, the strips of material 124 and 128 may be intertwined with one another so as to form a resilient tuft, while the mess associated with loose packing or filler materials falling onto the floor or clinging to various objects is alleviated.

Figure 11:
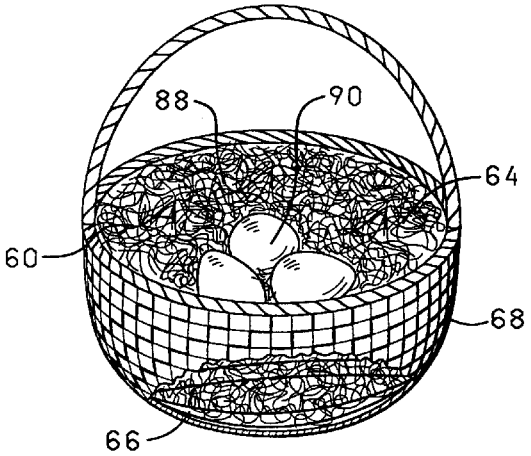
FIG. 11 is a partially cutaway, perspective view of a basket showing the sheet of packaging material of FIG. 8 inserted therein.

Like the packaging material 60 and 100 described above, the packaging material 120 may be provided with a bonding material to secure the packaging material 120 within a container, such as the basket 68 (FIG. 11). The border 126 is illustrated in FIG. 15 as having a strip of bonding material 130.

Also like the packaging material 60 and 100, the packaging material 120 may be coated with a bonding material in the manner described above in reference to the strips of material 12, 64 and 104, whereby the individual strips of material 124 and 128 of the packaging material 120 are caused to stick together when the strips of material 124 and 128 are amassed to form a tuft. As shown in FIG. 15, the strips of material 124 and 128 are provided with a bonding material 132.

The packaging material 120 is used in a manner identical to that described above in relation to the packaging material 60.

Figure 16:
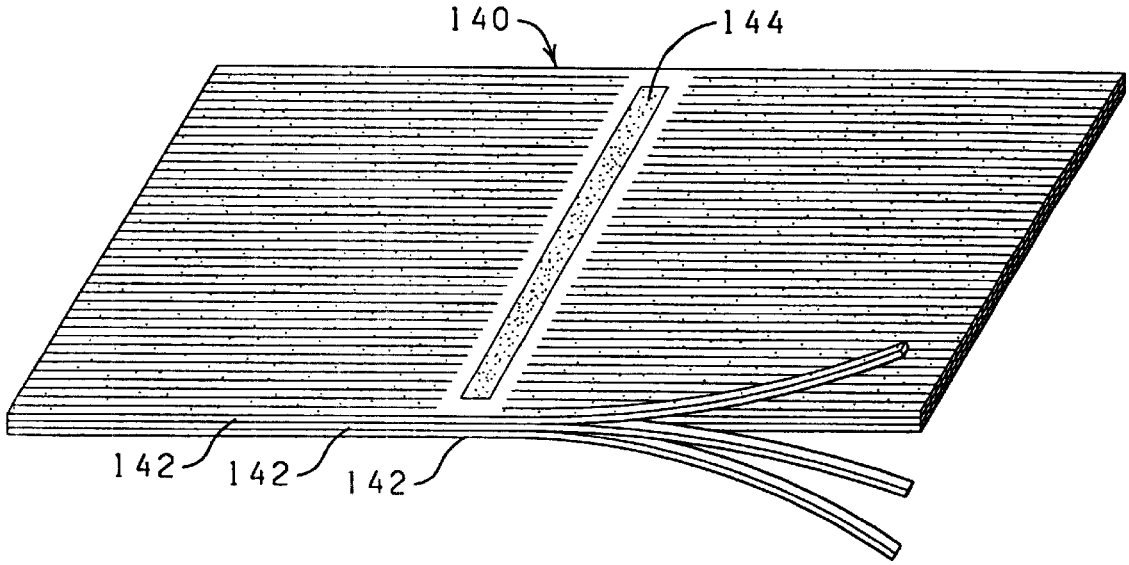
FIG. 16 is perspective view of another embodiment of a packaging material constructed in accordance with the present invention.

FIG. 16 illustrates yet another embodiment of a packaging material 140. The packaging material 140 is similar to the packaging material 100 described above with the exception that the packaging material 140 is constructed of a plurality of sheets of material 142 stacked and bonded together. Each sheet of material 142 is substantially identical to the sheets of material 122 described above. That is, each sheet of material 142 has a plurality of individual strips or strands of material extending from one side of a border and a plurality of strips of material extending from an opposing side of the border. The packaging material 140 may also include a bonding material 144 for securing the packaging material within a container and the strips of material of the packaging material 140 may be coated with a bonding material 144 whereby the individual strips of material of the packaging material 140 are-caused to stick together when the strips of material 140 are amassed to form a tuft.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A package, comprising:

a container;

a packaging material comprising a flexible sheet of material having a border with a first end having a plurality of strips of material extending therefrom and a second end having a plurality of strips of material extending therefrom such that the strips of material are integrally interconnected to one another so as to form a unitary mass and the strips of material intertwined with one another to form a resilient tuft, the packaging material positioned in the container and the border secured to the container; and an article positioned in the container and on the packaging material so that the resilient tuft of the packaging material cushionly supports the article.

2. A package, comprising:

a container;

a packaging material comprising a plurality of flexible sheets of material, each sheet of material having a border with a first end having a plurality of strips of material extending therefrom and a second end having a plurality of strips of material extending therefrom, the sheets of material secured to one another and the strips of material intertwined with one another to form a resilient tuft, the packaging material positioned in the container; and an article positioned in the container and on the packaging material so that the resilient tuft of the packaging material cushionly supports the article.

3. The package of claim 2 wherein the border of one of the sheets of material is secured to the border of an adjacent sheet of material.

4. The package of claim 2 wherein the packaging material is secured to the container.

5. The package of claim 4 wherein the packaging material is secured to the container along the border of at least one of the sheets of material.

6. The package of claim 5 wherein the packaging material is secured to the container with a bonding material.

7. A package, comprising:

a container;

a packaging material comprising a plurality of flexible sheets of material, each sheet of material having a border with a plurality of strips of material extending from at least one end thereof, the sheets of material secured to one another and the strips of material intertwined with one another to form a resilient tuft, the packaging material positioned in the container; and an article positioned in the container and on the packaging material so that the resilient tuft of the packaging material cushionly supports the article.

8. The package of claim 7 wherein the border of one of the sheets of material is secured to the border of an adjacent sheet of material.

9. The package of claim 7 wherein the packaging material is secured to the container.

10. The package of claim 9 wherein the packaging material is secured to the container along the border of at least one of the sheets of material.

11. The package of claim 10 wherein the packaging material is secured to the container with a bonding material.

12. A package, comprising:

a container;

a packaging material comprising a plurality of flexible sheets of material, each sheet of material having a border with a first end having a plurality of strips of material extending therefrom and a second end having a plurality of strips of material extending therefrom, the sheets of material secured to one another and positioned in the container; and an article positioned in the container and on the packaging material so that the packaging material cushionly supports the article.

13. The package of claim 12 wherein the border of one of the sheets of material is secured to the border of an adjacent sheet of material.

14. The package of claim 12 wherein the packaging material is secured to the container.

15. The package of claim 14 wherein the packaging material is secured to the container along the border of at least one of the sheets of material.

16. A package, comprising:

a container;

a packaging material comprising a plurality of flexible sheets of material, each sheet of material having a border with a plurality of strips of material extending from at least one end thereof, the sheets of material secured to one another and positioned in the container; and an article positioned in the container and on the packaging material so that the packaging material cushionly supports the article.

17. The package of claim 16 wherein the border of one of the sheets of material is secured to the border of an adjacent sheet of material.

18. The package of claim 16 wherein the packaging material is secured to the container.

19. The package of claim 18 wherein the packaging material is secured to the container along the border of at least one of the sheets of material.

* * * * *

UNITED STATES PATENT AND TRADEMARK OFFICE

CERTIFICATE OF CORRECTION

PATENT NO. : 6,561,356 B2
DATED : May 13, 2003
INVENTOR(S) : Donald E. Weder

It is certified that error appears in the above-identified patent and that said Letters Patent is hereby corrected as shown below:

Column 3,
Line 62, delete “log”.

Column 5,
Line 41, delete “at”.

Column 6,
Line 30, delete “Ho”.
Line 64, delete “It”.

Signed and Sealed this

Third Day of August, 2004

JON W. DUDAS
*Acting Director of the United States Patent and Trademark Office*